US009591404B1

(12) United States Patent
Chhetri

(10) Patent No.: US 9,591,404 B1
(45) Date of Patent: Mar. 7, 2017

(54) BEAMFORMER DESIGN USING CONSTRAINED CONVEX OPTIMIZATION IN THREE-DIMENSIONAL SPACE

(71) Applicant: Amazon Technologies, Inc., Reno, NV (US)

(72) Inventor: Amit Singh Chhetri, Santa Clara, CA (US)

(73) Assignee: Amazon Technologies, Inc., Seattle, WA (US)

( * ) Notice: Subject to any disclaimer, the term of this patent is extended or adjusted under 35 U.S.C. 154(b) by 454 days.

(21) Appl. No.: 14/040,138

(22) Filed: Sep. 27, 2013

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2203/12* (2013.01); *H04R 2430/25* (2013.01)

(58) Field of Classification Search
CPC .... H04R 3/005; H04R 2203/12; H04R 1/406; H04R 2430/25; H04R 2201/401; H04M 3/56
USPC ..... 381/122
See application file for complete search history.

(56) References Cited

U.S. PATENT DOCUMENTS 7,834,795 B1 * 11/2010 Dudgeon ..... G06K 9/6289 341/155
9,078,057 B2 * 7/2015 Yu ..... H04R 3/005
9,119,012 B2 * 8/2015 Ikizyan ..... H04R 3/00
9,129,587 B2 * 9/2015 Liu ..... G10K 11/002
9,264,799 B2 * 2/2016 Rosca ..... H04R 1/406
2008/0247565 A1 * 10/2008 Elko ..... H04R 3/005 381/92
2012/0093210 A1 * 4/2012 Schmidt ..... H04L 27/2624 375/224
2012/0093344 A1 * 4/2012 Sun ..... H04R 3/005 381/122

(Continued)

OTHER PUBLICATIONS

Pessentheimer et al., "*Improving Beamforming for Distant Speech Recognition in Reverberant Environments Using a Generic Algorithm for Planar Array Synthesis*", Signal Processing and Speech Communication Laboratory, Graz University of Technology, Graz, Austria, in 4 pages.

(Continued)

*Primary Examiner* — Thomas Alunkal
(74) *Attorney, Agent, or Firm* — Knobbe Martens Olson & Bear, LLP

(57) ABSTRACT

Embodiments of systems and methods are described for determining weighting coefficients based at least in part on using convex optimization subject to one or more constraints to approximate a three-dimensional beampattern. In some implementations, the approximated three-dimensional beampattern comprises a main lobe that includes a look direction for which waveforms detected by a sensor array are not suppressed and a side lobe that includes other directions for which waveforms detected by the microphone array are suppressed. The one or more constraints can include a constraint that suppression of waveforms received by the sensor array from the side lobe are greater than a threshold. In some implementations, the threshold can be dependent on at least one of an angular direction of the waveform and a frequency of the waveform.

22 Claims, 9 Drawing Sheets

(56) References Cited

U.S. PATENT DOCUMENTS

2013/0329907 A1* 12/2013 Bai ..... H04R 3/005
381/92

OTHER PUBLICATIONS

Mabande et al., "*Design of Robust Superdirective Beamformers as a Convex Optimization Problem*", University of Erlangen-Nuremberg, Multimedia Communications and Signal Processing, Erlangen, Germany, in 4 pages.

* cited by examiner

BEAMFORMER DESIGN USING CONSTRAINED CONVEX OPTIMIZATION IN THREE-DIMENSIONAL SPACE

BACKGROUND

Beamforming, which is sometimes referred to as spatial filtering, is a signal processing technique used in sensor arrays for directional signal transmission or reception. For example, beamforming is a common task in array signal processing, including diverse fields such as for acoustics, communications, sonar, radar, astronomy, seismology, and medical imaging. A plurality of spatially-separated sensors, collectively referred to as a sensor array, can be employed for sampling wave fields. Signal processing of the sensor data allows for spatial filtering, which facilitates a better extraction of a desired source signal in a particular direction and suppression of unwanted interference signals from other directions. For example, sensor data can be combined in such a way that signals arriving from particular angles experience constructive interference while others experience destructive interference. The improvement of the sensor array compared with reception from an omnidirectional sensor is known as the gain (or loss). The pattern of constructive and destructive interference may be referred to as a weighting pattern, or beampattern.

As one example, microphone arrays are known in the field of acoustics. A microphone array has advantages over a conventional unidirectional microphone. By processing the outputs of several microphones in an array with a beamforming algorithm, a microphone array enables picking up acoustic signals dependent on their direction of propagation. In particular, sound arriving from a small range of directions can be emphasized while sound coming from other directions is attenuated. For this reason, beamforming with microphone arrays is also referred to as spatial filtering. Such a capability enables the recovery of speech in noisy environments and is useful in areas such as telephony, teleconferencing, video conferencing, and hearing aids.

Signal processing of the sensor data of a beamformer generally involves processing the signal of each sensor with a filter weight and adding the filtered sensor data. This is known as a filter-and-sum beamformer. The filtering of sensor data can also be implemented in the frequency domain by multiplying the sensor data with known weights for each frequency, and computing the sum of the weighted sensor data. In this case, the weights can be obtained by transforming the filter coefficients to the frequency domain using a Fourier Transform. Applying a filter to a signal may alter the magnitude and phase of the signal. For example, a filter may pass certain signals unaltered but suppress others. The behavior of each filter can be represented by its weighting coefficients.

An initial step in designing a beamformer may be determining the desired beamformer filters or weights. These filters directly affect the desired beampattern, which represents the desired spatial selectivity of the beamformer. For example, if one is performing speech processing and the direction of a speaker is known, a beampattern may be desired that amplifies audio signals being received from the direction of the speaker but suppresses audio signals received from other directions. Once a desired beampattern is specified, filters can be designed for a beamformer to best approximate the desired beampattern. In particular, the spatial filtering properties of a beamformer can be altered through selection of weights for each microphone. Various techniques may be utilized to determine filter weighting coefficients to approximate a desired beampattern.

One technique that has been utilized to determine the filter weighting coefficients is a mathematical technique called constrained convex optimization. In mathematics, an optimization problem generally can have the following form:

$$\min_x f_0(x) \qquad x \in R^n$$
$$\text{subject to } f_i(x) \le b_i \quad i = 1, \ldots, m$$

where x is a vector (e.g., $x_1, \ldots, x_n$)) called the optimization variable, the function $f_0$ is called the objective function, the functions $f_i$ are called the constraint functions, and the constants $b_1, \ldots, b_m$ are called bounds, or constraints. A particular vector x* may be called optimal if it has the smallest objective value among all vectors that satisfy the constraints. Convex optimization is a type of optimization problem. In particular, a convex optimization problem is one in which the objective and constraint functions are convex, which means they satisfy the following inequality:

$$f_i(\alpha x+\beta y) \le \alpha f_i(x)+\beta f_i(y)$$

where $x \in R$, and $\alpha$ and $\beta$ are real numbers such that $\alpha+\beta=1$, $\alpha \ge 0$, $\beta \ge 0$.

When using convex optimization to select weighting coefficients, the optimization typically has been performed only in a two-dimensional space. For example, a desirable beampattern may be specified only in an x-y plane, where the beampattern is specified only as a function of an azimuth angle that specifies a direction in the x-y plane. For linear sensor arrays, this technique is sufficient because there is rotational symmetry about the sensor array axis. However, for sensor arrays arranged in two or three dimensions, such as planar sensor arrays, specifying the desirable beampattern in two-dimensional space results in poor performance for the beamformer. If the beamformer is implemented by using weighting coefficients that have been optimized for a two-dimensional beampattern, the performance of the beamformer may not match the desirable beampattern sufficiently closely over a three-dimensional space. For example, suppression of signals being received from unwanted directions may not be sufficient, causing unwanted noise to interfere with signals received from a desired direction. In particular, the directivity index (DI), which is a measure of the amount of noise suppression the beamformer provides in a spherically diffuse noise field, is very poor for beamformers designed using weighting coefficients that have been optimized over a two-dimensional space.

BRIEF DESCRIPTION OF DRAWINGS

Embodiments of various inventive features will now be described with reference to the following drawings. Throughout the drawings, reference numbers may be reused to indicate correspondence between referenced elements. The drawings are provided to illustrate example embodiments described herein and are not intended to limit the scope of the disclosure.

DETAILED DESCRIPTION

Embodiments of systems, devices and methods suitable for performing beamforming are described herein. Such techniques generally include receiving input signals captured by a sensor array (e.g., a microphone array), applying weighting coefficients to each input signal, and combining the weighted input signals into an output signal. In various embodiments, at least three input signals can be received from an at least two-dimensional sensor array that includes at least three sensors. Weighting coefficients can be applied to each input signal to generate at least three weighted input signals, and the at least three weighted input signals can be combined into an output signal.

The weighting coefficients can be determined based at least in part on using convex optimization subject to one or more constraints to approximate a three-dimensional beampattern. For example, the one or more constraints can include a first constraint that suppression of the waveform detected by the sensor array from a side lobe is greater than a threshold. The threshold can be dependent on at least one of an angular direction of the waveform and a frequency of the waveform.

The one or more constraints can include other constraints, whether independent of or in addition to the side lobe threshold constraint. For example, the one or more constraints can further include another constraint that a white noise gain of the three-dimensional beampattern is greater than another threshold. The white noise gain threshold also can be dependent on frequency. For example, in some embodiments, the white noise gain threshold can be relatively lower at higher frequencies than at lower frequencies.

The one or more constraints also can include a constraint that a waveform detected by a sensor array from a look direction receives a gain of unity. In comparison, a beampattern may be described as a set of directions for which suppression of a waveform is not more than 3 dB compared to the look direction.

In some embodiments, optimized weighting coefficients can be stored in a lookup table stored in a memory. After receiving input from a user selecting a location of the sensor array, the optimized weighting coefficients corresponding to the selected location can be retrieved from the lookup table.

Various aspects of the disclosure will now be described with regard to certain examples and embodiments, which are intended to illustrate but not to limit the disclosure.

Figure 1:
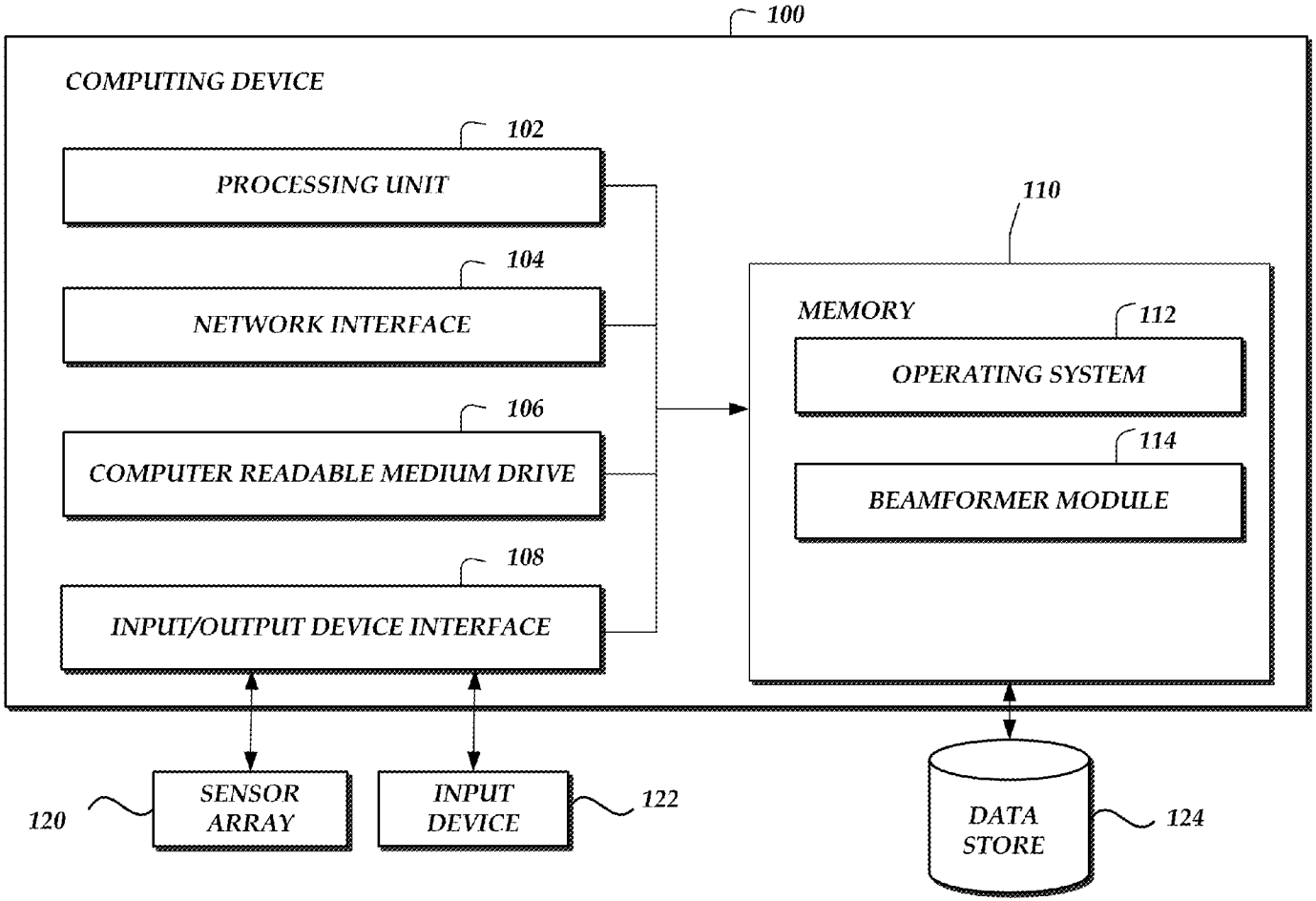
FIG. 1 is block diagram of an illustrative computing device configured to execute some or all of the processes and embodiments described herein.

FIG. 1 illustrates an example of a computing device 100 configured to execute some or all of the processes and embodiments described herein. For example, computing device 100 may be implemented by any computing device, including a telecommunication device, a cellular or satellite radio telephone, a laptop, tablet, or desktop computer, a digital television, a personal digital assistant (PDA), a digital recording device, a digital media player, a video game console, a video teleconferencing device, a medical device, a sonar device, an underwater echo ranging device, a radar device, or by a combination of several such devices, including any in combination with a network-accessible server. The computing device 100 may be implemented in hardware and/or software using techniques known to persons of skill in the art.

The computing device 100 can comprise a processing unit 102, a network interface 104, a computer readable medium drive 106, an input/output device interface 108 and a memory 110. The network interface 104 can provide connectivity to one or more networks or computing systems. The processing unit 102 can receive information and instructions from other computing systems or services via the network interface 104. The network interface 104 can also store data directly to memory 110. The processing unit 102 can communicate to and from memory 110. The input/output device interface 108 can accept input from the optional input device 122, such as a keyboard, mouse, digital pen, microphone, camera, etc. In some embodiments, the optional input device 122 may be incorporated into the computing device 100. Additionally, the input/output device interface 108 may include other components including various drivers, amplifier, preamplifier, front-end processor for speech, analog to digital converter, digital to analog converter, etc.

The memory 110 contains computer program instructions that the processing unit 102 executes in order to implement one or more embodiments. The memory 110 generally includes RAM, ROM and/or other persistent, non-transitory computer-readable media. The memory 110 can store an operating system 112 that provides computer program instructions for use by the processing unit 102 in the general administration and operation of the computing device 100. The memory 110 can further include computer program instructions and other information for implementing aspects of the present disclosure. For example, in one embodiment, the memory 110 includes a beamformer module 114 that performs signal processing on input signals received from the sensor array 120. For example, the beamformer module 114 can apply weighting coefficients to each input signal and combine the weighted input signals into an output signal, as described in more detail below in connection with FIG. 6. The weighting coefficients applied by the beamformer module 114 to each input signal can be optimized for a three-dimensional beampattern by convex optimization subject one or more constraints.

Memory 110 may also include or communicate with one or more auxiliary data stores, such as data store 124. Data store 124 may electronically store data regarding determined beampatterns and optimized weighting coefficients.

In other embodiments, the memory 110 may include a calibration module (not shown) for optimizing weighting coefficients according to a particular user's operating environment, such as optimizing according to acoustical properties of a particular user's room.

In some embodiments, the computing device 100 may include additional or fewer components than are shown in FIG. 1. For example, a computing device 100 may include more than one processing unit 102 and computer readable medium drive 106. In another example, the computing device 100 may not include or be coupled to an input device 122, include a network interface 104, include a computer readable medium drive 106, include an operating system 112, or include or be coupled to a data store 124. In some embodiments, two or more computing devices 100 may together form a computer system for executing features of the present disclosure.

Figure 2:
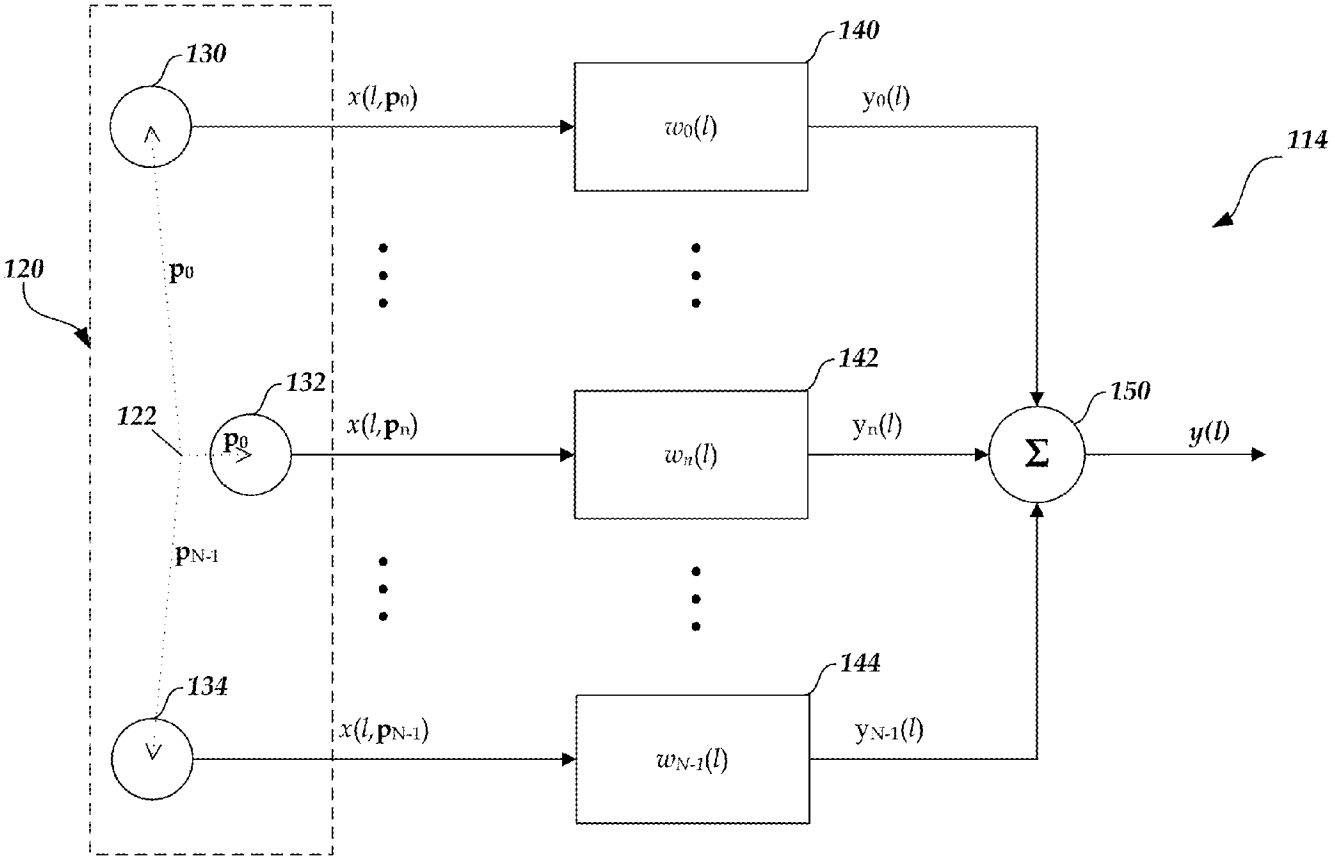
FIG. 2 is a signal diagram depicting an example of a sensor array and beamformer module according to an embodiment.

FIG. 2 is a signal diagram that illustrates the relationships between various signals and components that are relevant to beamforming. Certain components of FIG. 2 correspond to components from FIG. 1, and retain the same numbering. These components include beamformer module 114 and sensor array 120. Generally, the sensor array 120 is an at least two-dimensional sensor array comprising N sensors. As shown, the sensor array 120 is configured as a planar sensor array comprising three sensors, which correspond to a first sensor 130, an nth sensor 132, and an Nth sensor 134. In other embodiments, the sensor array 120 can comprise of more than three sensors. In these embodiments, the sensors may remain in a planar configuration, or the sensors may be positioned apart in a non-planar three-dimensional region.

Figure 3:
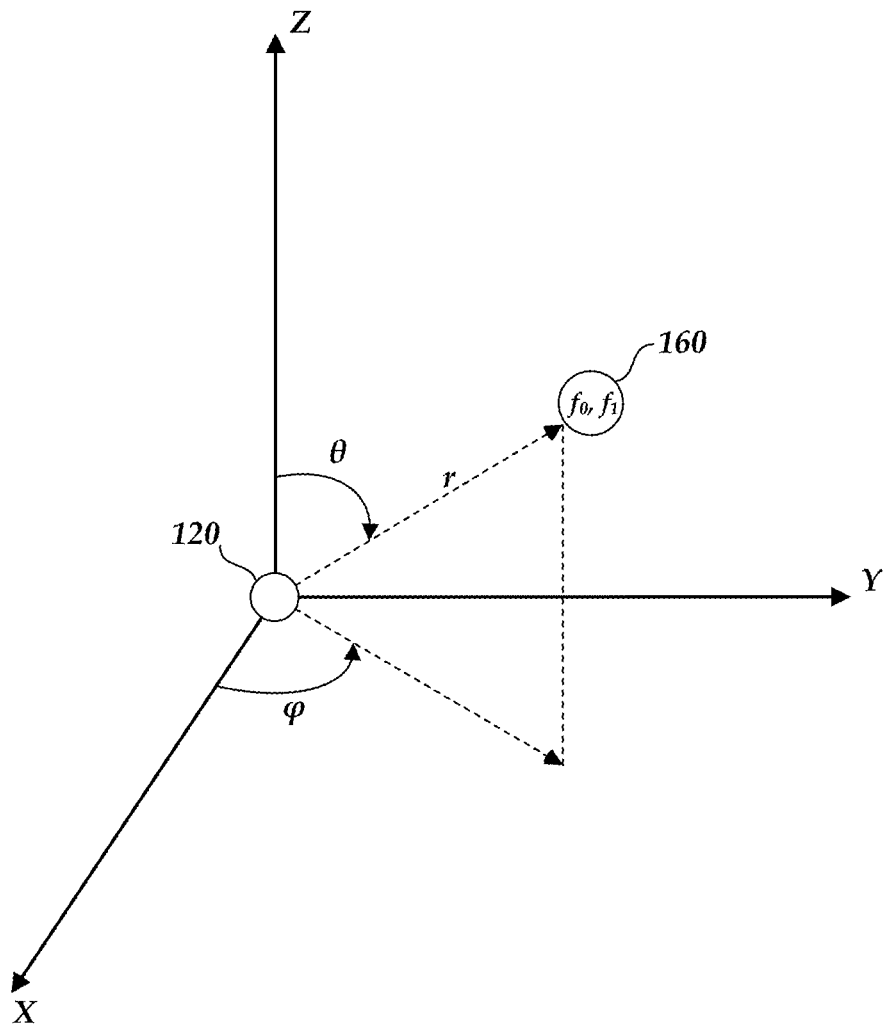
FIG. 3 is a diagram illustrating a spherical coordinate system according to an embodiment for specifying the location of a signal source relative to a sensor array.

The first sensor 130 can be positioned at a position $p_0$ relative to a center 122 of the sensor array 120, the nth sensor 132 can be positioned at a position $p_n$ relative to the center 122 of the sensor array 120, and the N−1th sensor 134 can be positioned at a position $p_{N-1}$ relative to the center 122 of the sensor array 120. The vector positions $p_0$, $p_n$, and $p_{N-1}$ can be expressed in spherical coordinates in terms of an azimuth angle $\phi$, a polar angle $\theta$, and a radius r, as shown in FIG. 3. Alternatively, the vector positions $p_0$, $p_n$, and $p_{N-1}$ can be expressed in terms of any other coordinate system.

Each of the sensors 130, 132, and 134 can comprise a microphone. In some embodiments, the sensors 130, 132, and 134 can be an omni-directional microphone having the same sensitivity in every direction. In other embodiments, directional sensors may be used.

Each of the sensors in sensor array 120, including sensors 130, 132, and 134, can be configured to capture input signals. In particular, the sensors 130, 132, and 134 can be configured to capture wavefields. For example, as microphones, the sensors 130, 132, and 134 can be configured to capture input signals representing sound. In some embodiments, the raw input signals captured by sensors 130, 132, and 134 are converted by the sensors 130, 132, and 134 and/or sensor array 120 to discrete-time digital input signals $x(l,p_0)$, $x(l,p_n)$, and $x(l,p_{N-1})$, as shown on FIG. 2. Although shown as three separated signals for clarity, the data of input signals $x(l,p_0)$, $x(l,p_n)$, and $x(l,p_{N-1})$ may be communicated by the sensor array 120 as part of a single data channel.

The discrete-time digital input signals $x(l,p_0)$, $x(l,p_n)$, and $x(l,p_{N-1})$ can be indexed by a discrete sample index l, with each sample representing the state of the signal at a particular point in time. Thus, for example, the signal $x(l,p_0)$ may be represented by a sequence of samples $x(0,p_0)$, $x(1,p_0)$, . . . $x(l,p_0)$. In this example the index/corresponds to the most recent point in time for which a sample is available.

A beamformer module 114 may comprise filter blocks 140, 142, and 144 and summation module 150. Generally, the filter blocks 140, 142, and 144 receive input signals from the sensor array, apply filters to the received input signals, and generate weighted input signals as output. For example, the first filter block 140 may apply a filter $w_0(l)$ to the received discrete-time digital input signal $x(l,p_0)$, the nth filter block 142 may apply a filter $w_n(l)$ to the received discrete-time digital input signal $x(l,p_n)$, and the N−1 filter block 144 may apply a filter $w_{N-1}(l)$ to the received discrete-time digital input signal $x(l,p_{N-1})$.

In some embodiments, the filters $w_0(l)$, $w_n(l)$, and $w_{N-1}(l)$ may be implemented as finite impulse response (FIR) filters of length L. For example, the filters $w_0(l)$, $w_n(l)$, and $W_{N-1}(l)$ may be implemented as having a filter length L of 512, although in other embodiments, any filter length may be used. The filters $w_0(l)$, $w_n(l)$, and $w_{N-1}(l)$ can comprise weighting coefficients that have been determined based at least in part on using convex optimization subject to one or more constraints to approximate a three-dimensional beampattern specified in relation to the sensor array 120, as described in more detail below. For example, the filter $w_0(l)$ can comprise weighting coefficients $w_{01}$, $w_{02}$, . . . , $w_{0L}$ that have been optimized for a three-dimensional beampattern by convex optimization.

To filter the discrete-time digital input signals $x(l,p_0)$, $x(l,p_n)$, and $x(l,p_{N-1})$, the filter blocks 140, 142, and 144 may perform convolution on the input signals $x(l,p_0)$, $x(l,p_n)$, and $x(l,p_{N-1})$ using filters $w_0(l)$, $w_n(l)$, and $w_{N-1}(l)$, respectively. For example, the weighted input signal $y_0(l)$ that is generated by filter block 140 may be expressed as follows:

$$y_0(l)=w_0(l)*x(l,p_0)$$

where '*' denotes the convolution operation. Similarly, the weighted input signal $y_n(l)$ that is generated by filter block 142 may be expressed as follows:

$$y_n(l)=w_n(l)*x(l,p_n)$$

Likewise, the weighted input signal $y_{N-1}(l)$ that is generated by filter block 144 may be expressed as follows:

$$y_{N-1}(l)=w_{N-1}(l)*x(l,p_{N-1})$$

Summation module 150 may determine an output signal y(l) based at least in part on the weighted input signals $y_0(l)$, $y_n(l)$, and $y_{N-1}(l)$. For example, summation module 150 may receive as inputs the weighted input signals $y_0(l)$, $y_n(l)$, and $y_{N-1}(l)$. To generate a spatially-filtered beamformer output signal y(l), the summation module 150 may simply sum the weighted input signals $y_0(l)$, $y_n(l)$, and $y_{N-1}(l)$. In other embodiments, the summation module 150 may determine an output signal y(l) based on combining the weighted input signals $y_0(l)$, $y_n(l)$, and $y_{N-1}(l)$ in another manner, or based on additional information.

As shown in FIG. 2, filter blocks 140, 142, and 144 receive and process discrete-time digital input signals $x(l,p_0)$, $x(l,p_n)$, and $x(l,p_{N-1})$, respectively. In other embodiments, signals captured by sensors 130, 132, and 134 may remain in analog form upon input to filter blocks 140, 142, and 144. Then, in some embodiments, the filter blocks 140, 142, and 144 convert the analog input signals into discrete-time digital input signals $x(l,p_0)$, $x(l,p_n)$, and $x(l,p_{N-1})$ before further processing. Alternatively, the filter blocks 140, 142, and 144 may allow the input signals to remain in analog form during processing, in which case the filter blocks 140, 142, and 144 would apply analog filters. In addition, summation module 150 may generate an analog spatially-filtered beamformer output signal y(t).

Turning now to FIG. 3, a spherical coordinate system according to an embodiment for specifying the location of a signal source relative to a sensor array is depicted. In this example, the sensor array 120 is shown located at the origin of the X, Y, and Z axes. A signal source 160 is shown at a position relative to the sensor array 120. The signal source 160 may generate waveforms comprising any frequencies. For example, signal source 160 may generate a first waveform having a first frequency $f_0$ at a first time and a second waveform having a second frequency $f_1$ at a second time, or frequencies $f_0$ and $f_1$ may be generated simultaneously. In a spherical coordinate system, the signal source is located at a vector position r comprising coordinates (r, $\phi$, $\theta$), where r is a radial distance between the signal source 160 and the center of the sensor array 120, angle $\phi$ is an angle in the x-y plane measured relative to the x axis, called the azimuth angle, and angle $\phi$ is an angle between the radial position vector of the signal source 160 and the z axis, called the polar angle. Together, the azimuth angle $\phi$ and polar angle $\theta$ can be included as part of a single vector angle $\Theta=\{\phi, \theta\}$ that specifies the angular direction of a detected waveform. In other embodiments, other coordinate systems may be utilized for specifying the position of a signal source or direction of a detected waveform. For example, the elevation angle may alternately be defined to specify an angle between the radial position vector of the signal source 160 and the x-y plane.

Using Constrained Convex Optimization to Determine Beamformer Filters

In some embodiments, a desired three-dimensional beampattern can be specified in relation to the sensor array, as described in more detail below with respect to FIGS. 4A and 4B. In particular, the desired three-dimensional beampattern can be specified in terms of a desired gain or attenuation of waveforms arriving at the sensor array from any particular direction. For example, the desired gain or attenuation of a waveform may be specified based on the angular direction of the detected waveform specified by the azimuth angle $\phi$ and the polar angle $\theta$. In addition, a set of discrete waveform frequencies can be defined as follows:

$$f_p,\ p=1, \ldots, P$$

Also, angular directions may be specified as a set of discrete angles:

$$\Theta_m=\{\phi_m,\theta_m\},\ m=1, \ldots, M$$

A number N can be used to denote the number of sensors, such as the number of microphones. In addition, $w_n(\bullet)$ can be used to denote the nth beamformer filter in the time domain. The discrete time Fourier transform (DTFT) may be applied to the weights $w_n(\bullet)$ to obtain a frequency-domain representation of the weights, $W_n(f)$, which may be expressed as:

$$W_n(f)=\sum_{l=0}^{L-1} w_n(l)e^{(-j2\pi f l)}$$

where L is the beamformer filter length in the time domain, f is the frequency of a detected waveform, e is a mathematical constant approximately equal to 2.71848, j is an imaginary number defined as $j^2=-1$, and $\pi$ is the mathematical constant. In addition, we can define $B(f_p, \Theta_m)$ as the desired beamformer response, which may depend on waveform frequency $f_p$ and waveform direction $\Theta_m$. The magnitude square of the desired beamformer response, $|B(f_p, \Theta_m)|^2$, provides the desired beampattern. We can also define $\hat{B}(f_p, \Theta_m)$ as the approximated beamformer response. Like the desired beamformer response $B(f_p, \Theta_m)$, the approximated beamformer response $\hat{B}(f_p, \Theta_m)$ may depend on waveform frequency $f_p$ and waveform direction $\Theta_m$. The approximated beamformer response $\hat{B}(f_p, \Theta_m)$ is a function of the weighting coefficients selected for the beamformer filters. When better weighting coefficients are selected for the beamformer filters, the beamformer may perform better at approximating the desired beamformer response. For example, the approximated beampattern may comprise a main lobe that includes a look direction for which waveforms detected by the sensor array are not suppressed and a side lobe that includes other directions for which waveforms detected by the sensor array are suppressed. Selection of better weighting coefficients for the beamformer filters may provide for less suppression of waveforms detected from the main lobe and greater suppression of waveforms detected from the side lobe. In addition, the design of weighting coefficients may depend on the environment in which the sensor array is located. For example, for a microphone array that processes sound, the desirable beamformer response may be specified based on the acoustical properties of a room in which the microphone array is located. As an example, if the microphone array is placed close to a wall, and it is desired to attenuate strong acoustic reflections that the array receives from the wall, the desirable beampattern can have a null or reduced response for sounds that arrive from the direction of the wall.

Mathematically, the approximate beamformer response $\hat{B}(f_p, \Theta_m)$ can be expressed as follows:

$$\frac{|W^H d(f_p, \Theta_{LD})|^2}{W^H W} \geq \gamma(f_p)$$

where $\tau_n(\Theta_m)$ is a function representing a time-of-arrival for a signal originating from angle $\Theta_m$ at the nth sensor. Here, $\tau_n(\Theta_m)$ is given as:

$$\hat{B}(f_p, \Theta_m)=\sum_{n=0}^{N-1} W_n(f_p)e^{(-j2\pi f_p \tau_n(\Theta_m))}$$

where, $p_n=\{p_n^x, p_n^y, p_n^z\}$ denotes the {x, y, z} coordinates for the microphone location $p_n$, and c denotes the speed of sound in air, which, under some circumstances, can be modeled as 343 m/s, for example.

In order to determine the weighting coefficients, a convex optimization problem can be specified. For example, let $W(f_p)\equiv[W_0(f_p), \ldots, W_{N-1}(f_p)]^T$ be a column vector comprising the beamformer weights in the frequency domain $W_n(f_p)$ for the pth frequency point. Then, we can define an objective function for the set of weights $W(f_p)$ as a function that minimizes the norm of the difference between the desired and approximated beamformer response for each frequency, as follows:

$$\tau_n(\theta_m)=-\left(\frac{p_n^x\sin(\theta_m)\cos(\varphi_m)+p_n^y\sin(\theta_m)\sin(\varphi_m)+p_n^z\cos(\theta_m)}{c}\right)$$

This objective function can be solved subject to one or more constraints. For example, a first constraint may specify that unity gain is applied in a look direction. A unity gain means that waveforms for which unity gain is applied are neither suppressed nor amplified. A look direction is the direction for which the least suppression of waveforms is intended. For example, for a microphone array configured to detect speech of a speaker, the look direction is the direction of the speaker. In other embodiments, a greater than unity gain can be applied in a look direction, meaning that waveforms detected from the look direction are amplified. For unity gain from the look direction, the constraint may be expressed as follows:

$$W^H d(f_p, \Theta_{LD})=1$$

where $W^H$ denotes the Hermitian-transpose of W and $d(f_p, \Theta_{LD})$ denotes the propagation vector for the planar waveform of frequency $f_p$ received from a look direction $\theta_{LD}$.

The one or more constraints may include another constraint that the white noise gain (WNG) is always above a threshold $\gamma$. In different embodiments, this constraint may be specified in addition to or in place of any other constraint. The threshold $\gamma$ may be a function of frequency. White noise is a random signal with a flat power spectral density, meaning that a white noise signal contains equal power within any frequency band of a fixed width. In the context of sensor arrays, white noise can imply that the sensor signals are pair-wise statistically independent. Further, for sensor arrays, white noise gain gives a measure of the ability of the sensor array to reject uncorrelated noise. In other words, a high white noise gain can indicate that the beamformer is robust to modeling errors that can arise from gain and phase mismatch within microphones and error in assumed look-direction, for example. This constraint may expressed as follows:

$$\min_{w} \left\| \hat{B}(f_p, \Theta) - B(f_p, \Theta) \right\|^2$$

An ideal beamformer design has high white noise gain and high directivity. However, there exists a tradeoff between white noise gain and directivity; as directivity increases, white noise gain generally decreases, and vice-versa. To achieve a certain level of directivity across frequencies, one generally can expect a lower white noise gain at low frequencies and higher white noise gain at higher frequencies. Accordingly, to maintain the same directivity across all frequencies, a lower threshold $\gamma$ may be specified at lower frequencies, while a higher threshold $\gamma$ may be specified at higher frequencies. An advantage of specifying a higher threshold $\gamma$ at higher frequencies is that doing so can allow better parameters to be chosen for other constraints at higher frequencies. For example, if too many constraints are chosen, or if overly aggressive constraint parameters are chosen for particular constraints, it may not be possible to determine weighting filters that solve the objective function, or the weighting filter solutions to the objective function may be too complex to implement in a real system. By relaxing the $\gamma$ constraint at higher frequencies, other constraints or more aggressive constraints may be realized.

The one or more constraints may include another constraint that suppression of waveforms detected by the sensor array from a side lobe is greater than a threshold. In different embodiments, this constraint may be specified in addition to or in place of any other constraint. The side-lobe threshold parameter generally provides an indication of the level of suppression of waveforms detected from undesired directions. Generally, a lower side-lobe threshold parameter can be used to achieve better performance at suppressing signals from undesired directions.

The side-lobe threshold can be dependent on at least one of an angular direction of the waveform and a frequency of the frequency of the waveform. For example, it may be desirable to specify greater side-lobe suppression for waveforms detected from a 90 degree angle relative to the look direction, but specify less suppression for waveforms detected from a smaller angle relative to the look direction. In particular, side lobe suppression can be expressed in terms of the set of all directions $\{\Theta_{SB}\}$ that define a stop band. A stop band direction $\Theta_{SB}$ is generally a direction for which suppression of a waveform is desired. For any waveform detected from a stop band direction $\Theta_{SB}$, the side-lobe threshold constraint can specify that suppression of such a waveform is greater than a particular threshold. In other words, the magnitude of a waveform detected from a stop band direction $\Theta_{SB}$ can be less than a particular threshold. For example, the side lobe level constraint may be expressed as follows:

$$|W^H d(f_p, \Theta_{SB})|^2 \leq \epsilon(f_p, \Theta_{SB})$$

wherein $d(f_p, \Theta_{SB})$ denotes a propagation vector for waveform signals having a frequency $f_p$ and arriving from the set of directions $\{\Theta_{SB}\}$ that define the stop band. The side lobe level constraint parameter, $\epsilon(f_p, \Theta_{SB})$, also can be a function of frequency $f_p$ and stop-band angles $\Theta_{SB}$. Although the term "side" lobe level is used, it should be understood that a side lobe can be directed in any of the directions $\Theta_{SB}$ that define the stop band, including a back lobe or lobe in other directions. For example, any lobe that is not directed in the look direction may comprise a side lobe.

The constrained convex optimization problem described above-using the objective function to find the set of weights $W(f_p)$ that minimizes the norm of the difference between the desired and approximated beamformer response, subject to each of the one or more constraints—can be solved for each frequency point using a convex optimization solver. After the weights $W(f_p)$ have been determined in the frequency domain, an inverse Fourier transform can be used to determine the beamformer filter in the time domain. The constrained convex optimization problem can be solved using any known method, including least squares, for example. Generally, an iterative procedure can be used to find the weights $W(f_p)$ that minimize the objective function.

Three-Dimensional Beampattern

Figure 4A:
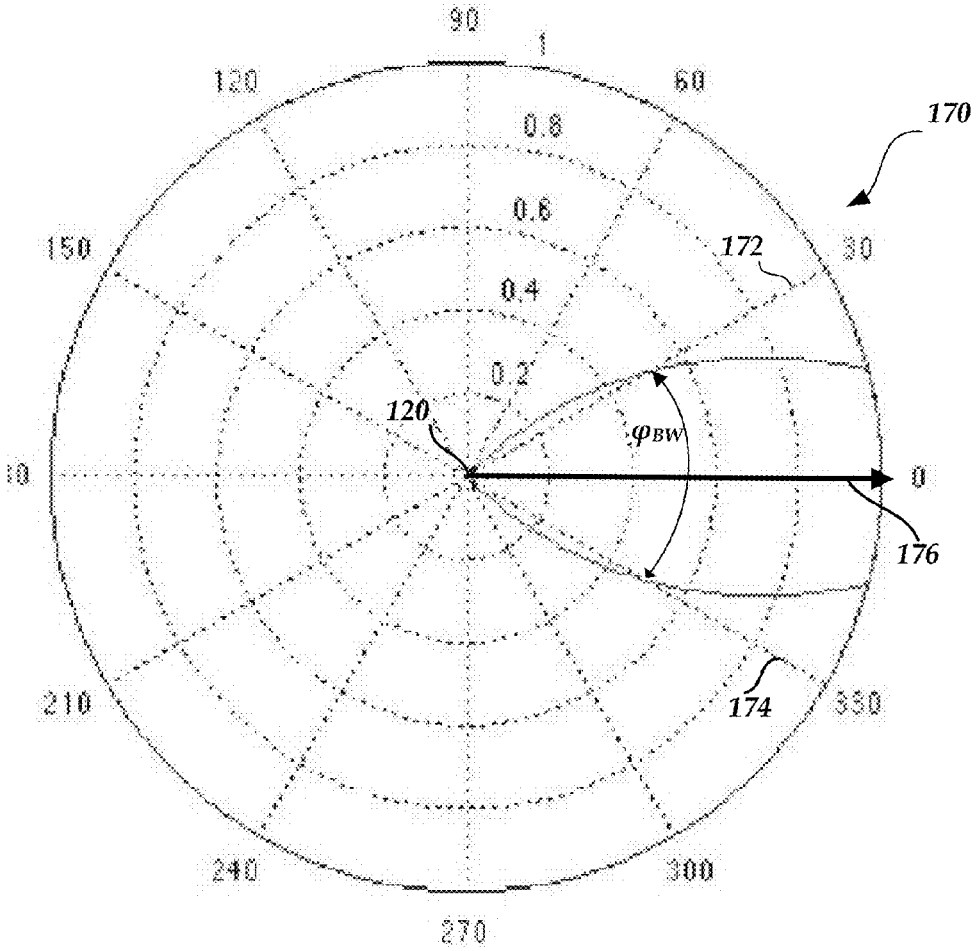
FIG. 4A is a diagram illustrating an example of a two-dimensional beampattern.

FIG. 4A illustrates an example of a two-dimensional beampattern 170 specified as a function of an azimuth angle $\phi$. For example, the beampattern 170 generally is specified in relation to the center of the sensor array 120, located at the origin, and extends in a look direction 176. The look direction 176 generally defines a direction in which a beamformer is designed to apply a minimum suppression. In this example, the look direction 176 extends at an azumuth angle of 0 degrees $\phi$, along the x axis. An azimuth angle corresponding to 0 degrees can be chosen arbitrarily. For example, for convenience, a look direction can be chosen to correspond to an azimuth angle of 0 degrees. In a physical system, the azimuth angle may indicate an angle of deviation from the look direction in a horizontal plane.

The two-dimensional beampattern 170 can be expressed as having an upper angle boundary 172 and a lower angle boundary 174. The beamformer is designed to pass waveforms detected from within the upper angle boundary 172 and lower angle boundary 174 with less suppression than waveforms detected from other angles. For example, the beampattern 170 specifies an upper angle boundary 172 of 30 degrees. As shown, signals originating from an angle of 30 degrees are suppressed by about 0.5, or half as much, compared to signals originating from look direction 176. In other words, signals originating from an angle of 30 degrees are suppressed by −3 dB compared to signals originating from the look direction 176. Similarly, the beampattern 170 specifies a lower angle boundary 174 of 330 degrees, or −30 degrees. As shown, signals originating from an angle of −30 degrees are suppressed by about 0.5, or half as much, compared to signals originating from look direction 176. In other words, signals originating from an angle of −30 degrees are suppressed by −3 dB compared to signals originating from the look direction 176. At angles from −30 degrees and +30 degrees, signals are suppressed by no more than −3 dB, whereas at angles from +30 degrees to +330 degrees, signals are suppressed by more than −3 dB.

An angle between the upper and lower angle boundaries 172 and 174 of the beampattern 170 may be referred to as a beam width $\phi_{BW}$. The beamwidth $\phi_{BW}$ is specified in terms of the angle enclosed between the two 3 dB points on the main lobe of the beampattern. Here, the 3 dB points can be defined as the points on the main lobe that are closest to the look-direction and the beampattern at these points is 3 dB lower than the pattern at the look direction. In this example, the beam width $\phi_{BW}$ is 60 degrees. As the beam width is made more narrow, the selectivity of the spatial filtering capability of the beamformer can increase.

Figure 4B:
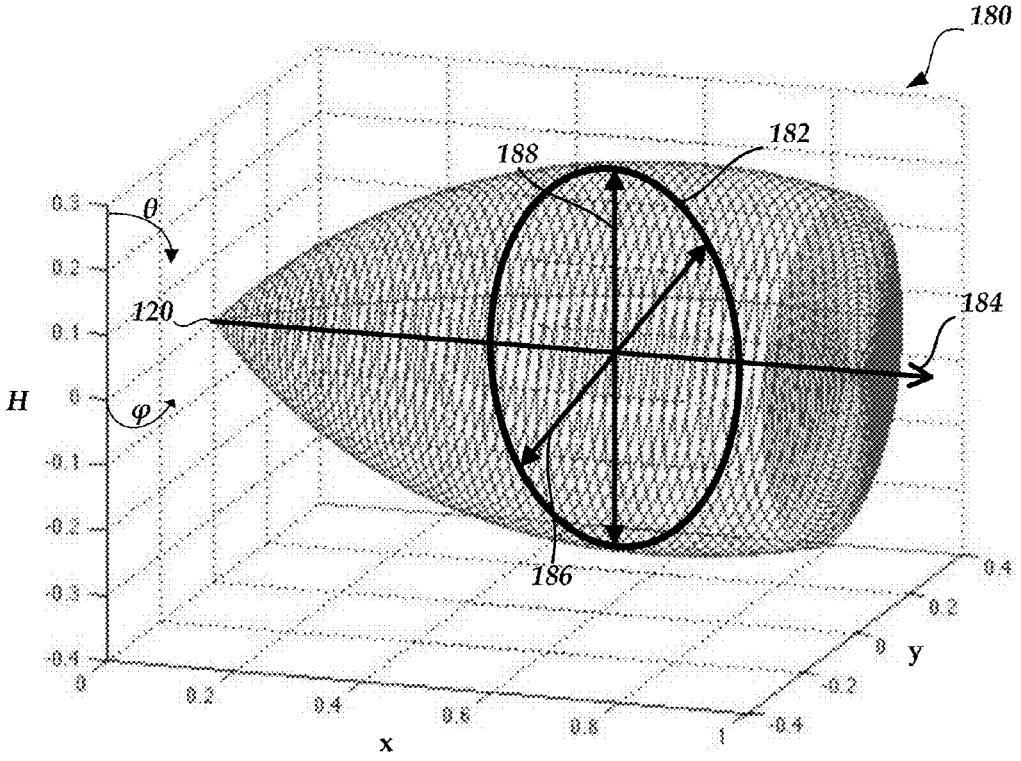
FIG. 4B is a diagram illustrating an example of a three-dimensional beampattern.

FIG. 4B illustrates an example of a three-dimensional beampattern 180.

According to an embodiment, the three-dimensional beampattern 180 can be specified as a function of an azimuth angle $\phi$ and a polar angle $\theta$. In addition, the three-dimensional beampattern 180 can be dependent on the frequency of the detected waveforms. For example, weighting coefficients may be specified according to a desired beampattern 180 as shown in FIG. 4B that are used to filter detected waveforms having a frequency $f_0$, but the weighting coefficients may be configured for a different beampattern (not shown) for detected waveforms having a different frequency $f_1$. Accordingly, the level of suppression at a side lobe of a beampattern may vary not only azimuth angle $\phi$ and a polar angle $\theta$, but also with frequency.

Like the beampattern shown in FIG. 4A, the three-dimensional beampattern 180 shown in FIG. 4B also originates from the center of the sensor array 120, located at the origin (0, 0, 0), and extends in a look direction 184. In this example, the look direction 184 generally extends at an azumuth angle of 0 degrees and a polar angle of 90 degrees, along the x axis.

The three-dimensional beampattern 180 can be expressed as having a surface boundary. The magnitude of this surface pattern for a given azimuth $\phi$ and a polar angle $\theta$ denotes the level of amplification that a desirable beamformer would apply on a signal arriving from that direction. To compute the magnitude, one can find a point on the surface pattern that subtends the azimuth $\phi$ and polar angle $\theta$ with respect to the origin. The magnitude of the pattern would then be equal to the distance of this point from the origin. Generally, the maximum magnitude is specified as 0 dB. For example, if the surface pattern has a value of 0 dB for the look-direction, any signal that arrives from look direction would pass through without any suppression. Likewise, if the surface pattern has a value of −3 dB for another direction, any signal that arrives from that direction would be suppressed by 3 dB. At any cross-sectional slice of the beampattern 180, the beampattern 180 may be shaped as a circle or as an ellipse. In other embodiments, the beampattern 180 may have any other conceivable shape.

A horizontal azimuth angle measured at the slice of surface boundary 182 between a left-side −3 dB boundary angle and a right-side −3 dB boundary angle of surface boundary 182 may be referred to as a horizontal beam width 186. A vertical polar angle between a lower −3 dB boundary angle and an upper −3 dB boundary angle of surface boundary 182 may be referred to as a vertical beam width 188. In some embodiments, the three-dimensional beampattern 180 may be designed so that a vertical beam width 188 is larger than a horizontal beam width 186. This may be desirable, for example, when using the beamformer to spatially filter for speech originating from a person at a particular location. If the location of the person is known, it may be desirable to design a beampattern with a relatively small horizontal beam width in order to suppress any audio signals originating at different locations in a room. However, the height at which the person is speaking may not be known, so it may be desirable to design a beampattern with a relatively large vertical beam width in order to accommodate a range of speaking heights without suppression.

Figure 4C:
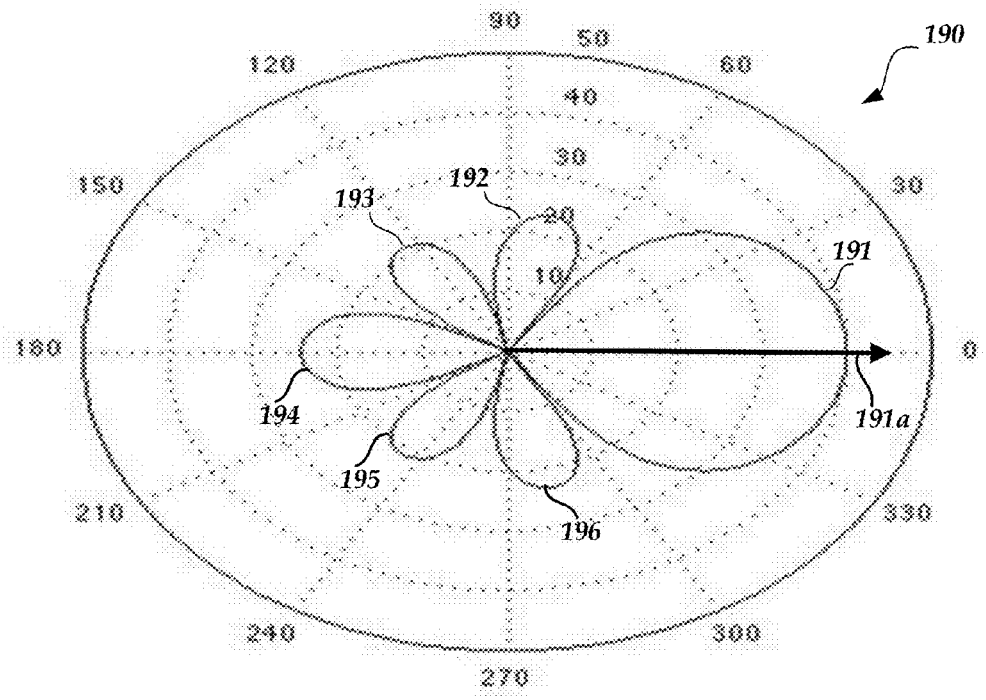
FIG. 4C is a diagram illustrating an example of a multi-lobe two-dimensional beampattern.

FIG. 4C illustrates an example of a multi-lobe two-dimensional beampattern 190. As shown, the beampattern 190 includes a main lobe 191 and side lobes 192, 193, 194, 195, 196. In this example, the main lobe 191 comprises a look direction 191*a* that extends at an azumuth angle of 0 degrees $\phi$, along the x axis. As shown, signals coming from each of the side lobes 192, 193, 194, 195, 196 are suppressed more than signals from the main lobe 191. As used herein, side lobe refers to any lobe that is not a main lobe, but does not imply direction. For example, each of side lobes 192, 193, 194, 195, and 196 extend in different directions. In this embodiment, side lobe 192 extends from approximately 60 to 105 degrees, side lobe 193 extends from approximately 105 to 150 degrees, side lobe 194 extends from approximately 150 to 210 degrees, side lobe 195 extends from approximately 210 to 255 degrees, and side lobe 196 extends from approximately 255 to 300 degrees, whereas in other embodiments, side lobes can extend in any specified direction. Because side lobe 194 extends in a direction opposite to the look direction 191*a*, side lobe 194 also may be referred to as a back lobe.

Figure 5:
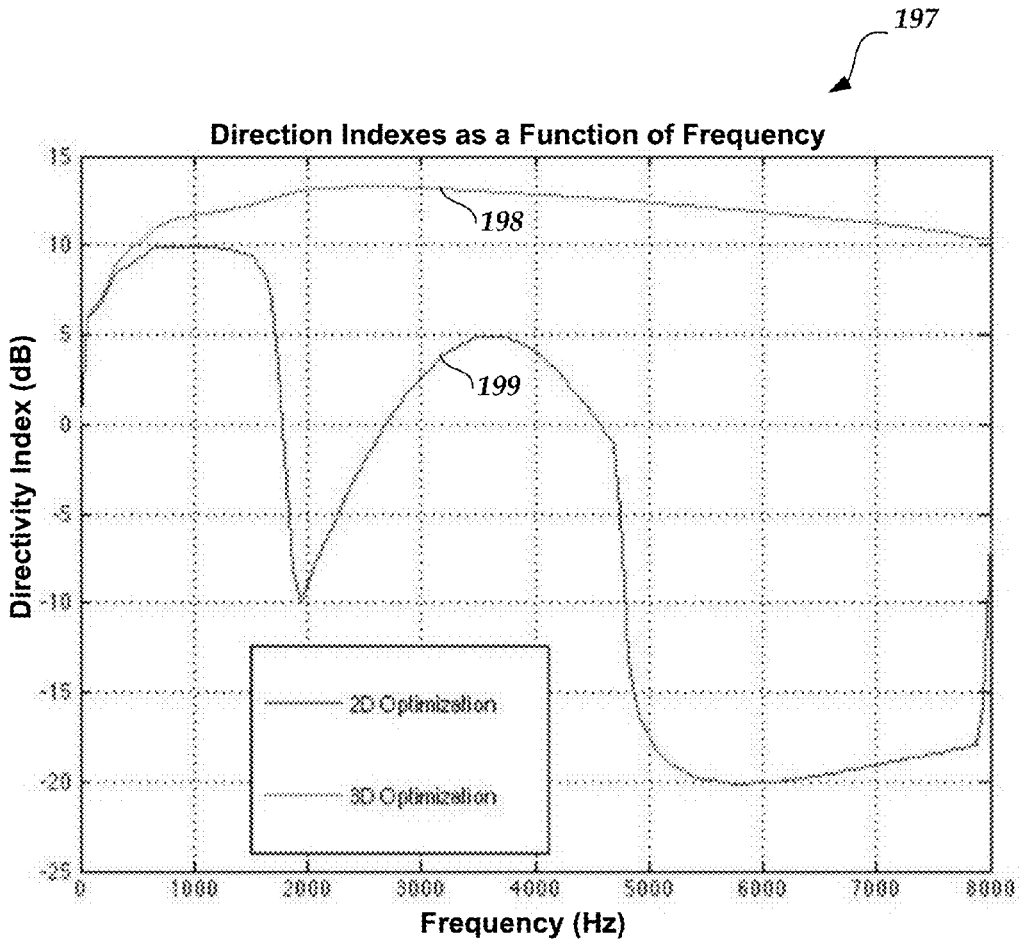
FIG. 5 is an example graph illustrating the directivity index, as a function of frequency, of a three-dimensional beamformer according to an embodiment compared to a two-dimensional beamformer.

FIG. 5 illustrates a comparative graph 197 depicting directivity index as a function of frequency for a two-dimensional beamformer specified according to FIG. 4A and for a three-dimensional beamformer specified according to FIG. 4B. In general, directivity index is generally a measure of the amount of noise suppression the beamformer provides in a spherically diffuse noise field. In particular, directivity index 198 corresponds to the noise suppression achieved when filter weighting coefficients were determined based at least in part on using convex optimization subject to one or more constraints to approximate a three-dimensional beampattern. Directivity index 199 corresponds to the noise suppression achieved when filter weighting coefficients were determined based using convex optimization subject to approximate only a two-dimensional beampattern.

As shown in FIG. 5, the noise suppression of the beamformer designed by specifying a desired three-dimensional beampattern outperforms the noise suppression of the beamformer designed by specifying a two-dimensional beampattern at every measured frequency. For example, at a frequency of 2000 Hz, the directivity index 198 is more than 20 dB greater than the directivity index 199, indicating that at 2000 Hz the beamformer designed by specifying a desired three-dimensional beampattern achieves over 100 times the noise suppression of the beamformer designed by specifying a two-dimensional beampattern.

Beamforming Process

Figure 6:
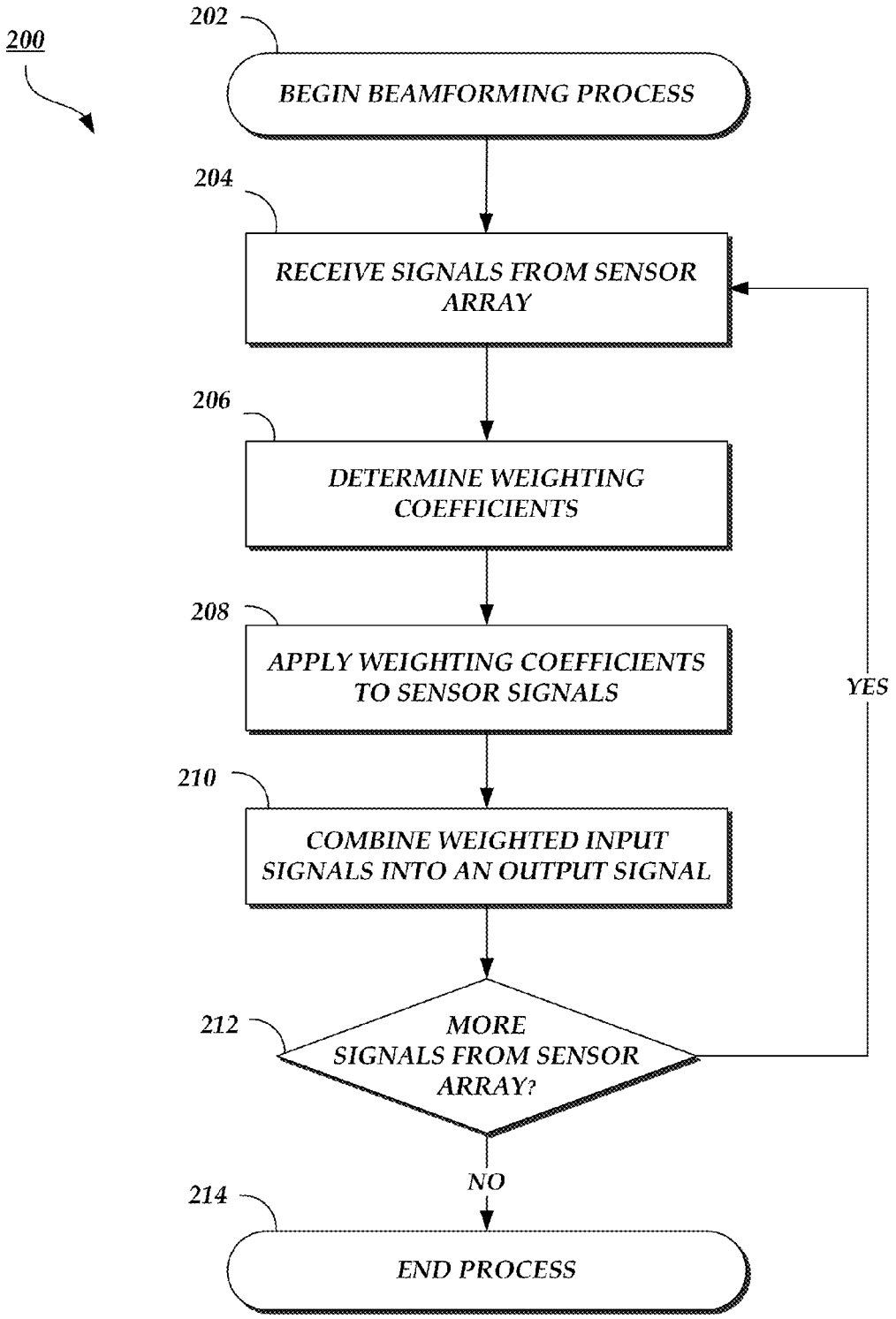
FIG. 6 is a flow diagram illustrating an embodiment of a beamformer routine.

Turning now to FIG. 6, an example process 200 for performing a beamforming process is depicted. The process 200 may be performed, for example, by the beamformer module 114 and processing unit 102 of the device 100 of FIG. 1. Process 200 begins at block 202. A beamforming module receives signals from a sensor array at block 204. For example, the sensor array may include an at-least two dimensional sensor array as shown in FIG. 2. The sensor array can comprise at least three sensors, and each of the at least three sensors can detect an input signal. For example, each of the at least three sensors can comprise a microphone, and each microphone can detect an audio input signal. The at least three sensors in the sensor array may be arranged at any position. A beamforming module can receive each of the at least three input signals. In some embodiments, the at least three input signals can comprise discrete-time digital input signals $x(l,p_0)$, $x(l,p_n)$, and $x(l,p_{N-1})$.

Next, at block 206, weighting coefficients are optionally determined. For example, in some embodiments, determining the weighting coefficients may comprise retrieving the weighting coefficients from a memory, as described below with respect to FIG. 7. In these embodiments, the retrieved weighting coefficients may be applied continuously without a determining step each time the weighting coefficients are applied. In other embodiments, weighting coefficients may be hard coded into a system, and, as such, the weighting coefficients, which were determined in advance, can be applied without ever being determined by the system. In other embodiments, weighting coefficients can be calculated during operation of a beamforming device. For example, for adaptive beamforming that may adjust to changes in an environment, weighting coefficients can be determined in real time. In particular, weighting coefficients can be determined in real time based on a calibration module.

The weighting coefficients can be determined for the at least three filters $w_0(l)$, $w_0(l)$, and $w_{N-1}(l)$ of filter blocks 140, 142, and 144. The weighting coefficients may have been determined based at least in part on using convex optimization subject to one or more constraints to approximate a three-dimensional beampattern. The one or more constraints may include a first constraint that suppression of the waveform detected by the sensor array from a side lobe is greater than a threshold. In some embodiments, the threshold is dependant on a stop-band angle. The threshold can also be dependent on frequency.

The one or more constraints may also include other constraints, whether independent or in addition to the side lobe constraint. For example, a second constraint can specify that a white noise gain of the approximated three-dimensional beampattern is greater than another threshold. The white noise gain threshold also can be dependent on frequency. For example, in some embodiments, the white noise gain threshold can relatively lower at higher frequencies than at lower frequencies. In general, white noise gain is more severe at relatively lower frequencies, so this constraint can be relaxed to some extent at relatively higher frequencies.

In another embodiment, a constraint is a waveform detected by the sensor array from a look direction is applied a gain of unity.

In some embodiments, optimized weighting coefficients can be stored in a lookup table stored in a memory. After receiving input from a user selecting a location of the sensor array, the optimized weighting coefficients can be determined by retrieving from a lookup table coefficients that have been optimized corresponding to the selected location, as described below in more detail in connection with FIG. 7. Possible locations that a user may select include in close proximity to a wall, near a center of a room, and near a corner, among other locations. The optimized weighting coefficients stored in memory may be designed to fit different three-dimensional beampatterns depending on the selected location.

For example, if the sensor array is close proximity to a wall, the beampattern may be designed such that a back lobe that extends from the sensor array towards the wall is smaller than a main lobe extending from the sensor array away from the wall. The reason for having a smaller back lobe for a wall position is that if a sensor array is in close proximity to a wall, a desired signal source that one may wish to isolate is unlikely to be located between the sensor array and the wall. By designing a beampattern with a larger front lobe, the beamformer can filter to isolate a desired signal source, whereas the relatively smaller back lobe can minimize reflections from the wall that otherwise could cause distortion. Alternatively, if the sensor array is in the middle of a room, it may be desirable to have a beampattern with a larger back lobe than was desirable for the wall-location example. When the sensor array is in the middle of a room, the reflections arriving from the back are not as severe as where the sensor array is close to a wall. Accordingly, when the sensor array is in the middle of the room, the size of the back lobe can be relaxed (e.g., made larger), which can help to allocate this extra degree of freedom (through relaxed back lobe constraint) to other beamformer constraints.

In other embodiments, the weighting coefficients could be calculated to be tailored to the acoustical properties of a particular room using a calibration module. For example, the calibration module could measure the acoustical properties of a particular room. In addition, the calibration module may be able to measure the acoustical properties of a particular room relative to the sensor array. After measuring the current acoustical properties of the room, the calibration module may consult a lookup table to select weighting coefficients that are most closely correlated with the acoustical properties of the room. In an alternative embodiment, the calibration module may determine the weighting coefficients that are optimized according to the measured acoustical properties by communicating with a server over a network. In other alternative embodiments, the calibration module may determine weighting coefficients for the signal filters by solving a constrained convex optimization problem for the desired three-dimensional beampattern.

At block 208, the determined weighting coefficients are applied to the received sensor signals. For example, the input signal $x(l,p_0)$ can be filtered by convolution with filter $w_0(l)$ comprising a first set of weighting coefficients, the input signal $x(l,p_n)$ can be filtered by convolution with filter $w_0(l)$ comprising an nth set of weighting coefficients, and the input signal $x(l,p_{N-1})$ can be filtered by convolution with filter $w_{N-1}(l)$ comprising an N−1 set of weighting coefficients. Applying the weighting coefficients of filters $w_0(l)$, $w_n(l)$, and $w_{N-1}(l)$ to the received sensor signals may generate the weighted input signals $y_0(l)$, $y_n(l)$, and $y_{N-1}(l)$, as shown in FIG. 2. In some embodiments, the beamformer processing may also be implemented more computationally efficiently in the frequency domain by making use of an overlap-and-add structure in conjunction with fast Fourier transform (FFT) techniques.

At block 210, an output signal is determined based at least in part on the weighted input signals. For example, a summation module may sum the weighted input signals $y_0(l)$, $y_n(l)$, and $y_{N-1}(l)$ to generate a spatially-filtered beamformer output signal $y(l)$, as shown in FIG. 2.

At block 212, in some embodiments, it may be determined whether more signals are continuing to be received from the sensor array. If yes, the process 200 may revert back to block 204, and the beamforming process 200 may continue as described above. If not, the beamforming process 200 ends at block 214.

Figure 7:
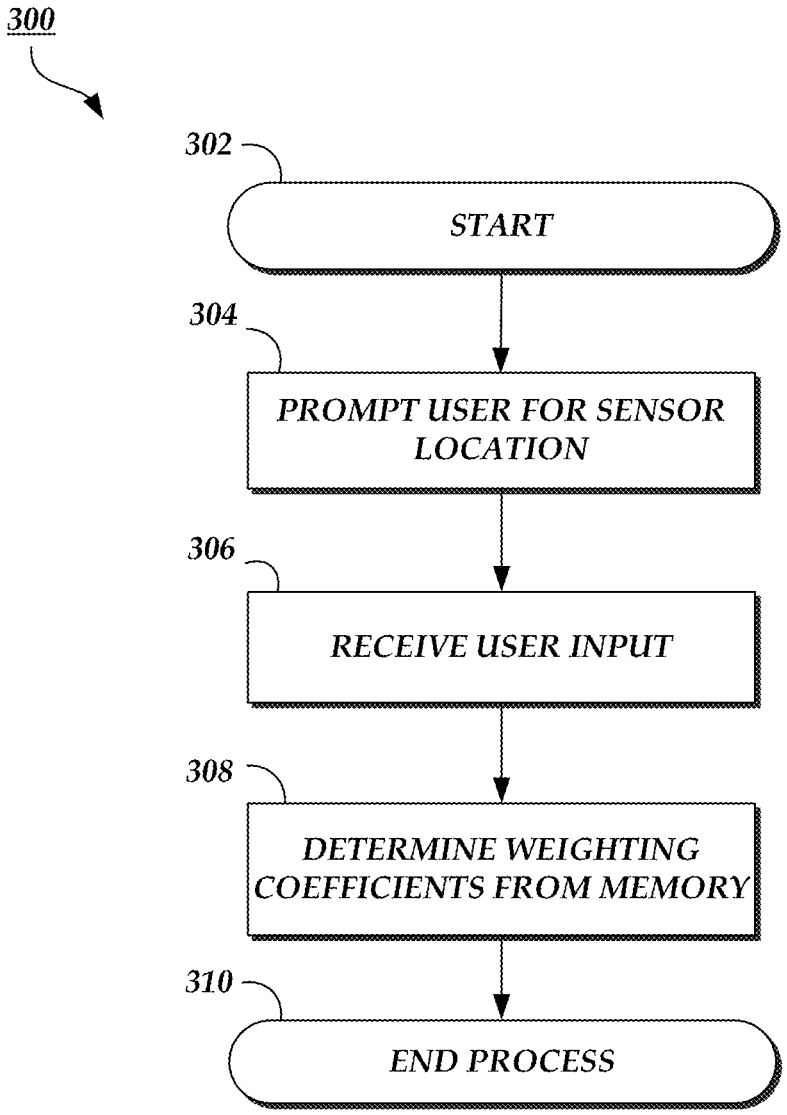
FIG. 7 is a flow diagram illustrating an embodiment of a routine for determining weighting coefficients of a beamformer.

FIG. 7 illustrates an example process 300 for receiving user input and determining weighting coefficients for a beamformer. The process 300 may be performed, for example, by the beamformer module 114, processing unit 102, and data store 124 of the device 100 of FIG. 1. Process 300 begins at block 302. A user is prompted to enter a location of the sensor array at block 304. The prompt may provide a list of possible choices, including in close proximity to a wall, near a center of a room, and near a corner, among other locations. The prompt may be provided via a display, or, alternatively, by an automated voice prompt.

At block 306, input is received from a user. For example, a user may provide input selecting one of the available locations for the sensor array and room types. The user may provide the input by using an electronic input device, or, alternatively, by speech.

At block 308, weighting coefficients based on the user-selected sensor array location are determined from a memory or other data source. In particular, the weighting coefficients can be stored in memory as a lookup table. For example, the weighting coefficients may be retrieved from a memory. In an embodiment, weighting coefficients for the at least three filters $w_0(l)$, $w_n(l)$, and $w_{N-1}(l)$ of filter blocks 140, 142, and 144 can be retrieved from a lookup table. The weighting coefficients may have been determined based at least in part on using convex optimization subject to one or more constraints to approximate a three-dimensional beampattern.

The weighting coefficients stored in the memory can be based on experimental data of average acoustical properties corresponding to the selected location. For example, the acoustical properties of many rooms can be measured. Based on the average acoustical properties of rooms, weighting coefficients that have been optimized using constrained convex optimization can be determined and stored in the memory. After the weighting coefficients for the filters have been determined, the process 300 ends at block 310.

Terminology

Depending on the embodiment, certain acts, events, or functions of any of the processes or algorithms described herein can be performed in a different sequence, can be added, merged, or left out all together (e.g., not all described operations or events are necessary for the practice of the algorithm). Moreover, in certain embodiments, operations or events can be performed concurrently, e.g., through multi-threaded processing, interrupt processing, or multiple processors or processor cores or on other parallel architectures, rather than sequentially.

The various illustrative logical blocks, modules, routines and algorithm steps described in connection with the embodiments disclosed herein can be implemented as electronic hardware, computer software, or combinations of both. To clearly illustrate this interchangeability of hardware and software, various illustrative components, blocks, modules and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The steps of a method, process, routine, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of a non-transitory computer-readable storage medium. An exemplary storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each be present.

While the above detailed description has shown, described and pointed out novel features as applied to various embodiments, it can be understood that various omissions, substitutions and changes in the form and details of the devices or algorithms illustrated can be made without departing from the spirit of the disclosure. As can be recognized, certain embodiments of the inventions described herein can be embodied within a form that does not provide all of the features and benefits set forth herein, as some features can be used or practiced separately from others. The scope of certain inventions disclosed herein is indicated by the appended claims rather than by the foregoing description. All changes which come within the meaning and range of equivalency of the claims are to be embraced within their scope.

What is claimed is:

1. An apparatus comprising:

a microphone array comprising at least three microphones arranged in a planar array, each of the at least three microphones configured to detect sound as an audio input signal;

one or more processors in communication with the microphone array, the one or more processors configured to:

apply weighting coefficients to each audio input signal to generate at least three weighted input signals; and determine an output signal based at least in part on the weighted input signals;

wherein the weighting coefficients are determined based at least in part on using convex optimization subject to one or more constraints to approximate a three-dimensional beampattern specified in relation to the microphone array, wherein the approximated three-dimensional beampattern comprises a main lobe that includes a look direction for which sound detected by the microphone array is not suppressed and a side lobe that includes another direction for which sound detected by the microphone array is suppressed, and wherein the one or more constraints of the convex optimization includes a first constraint that suppression, of sound detected by the microphone array from the side lobe, is greater than a predetermined threshold, the predetermined threshold being dependent on at least a frequency of the sound.

2. The apparatus of claim 1, wherein the one or more constraints further include a second constraint that a white noise gain of the approximated three-dimensional beampattern is greater than a second threshold.

3. The apparatus of claim 2, wherein the second threshold is dependent on the frequency of the sound, the second threshold comprising a first value at a first frequency and a second value at a second frequency higher than the first frequency, wherein the second value is lower than the first value.

4. The apparatus of claim 1, wherein the one or more constraints further include a second constraint that sound detected by the microphone array from the look direction receives a gain of unity.

5. The apparatus of claim 1, wherein the approximated three-dimensional beampattern comprises a horizontal beam width and a vertical beam width, and wherein the vertical beam width is greater than the horizontal beam width.

6. The apparatus of claim 1, wherein the one or more processors are further configured to:

receive input from a user selecting a location of the sensor array; and determine the weighting coefficients based on the selected location from a memory.

7. A signal processing method comprising:

receiving at least three input signals from a sensor array comprising at least three sensors arranged in a planar array, each of the at least three input signals detected by one of the at least three sensors;

applying weighting coefficients to each input signal to generate at least three weighted input signals; and determining an output signal based at least in part on the weighted input signals;

wherein the weighting coefficients are determined based at least in part on using convex optimization subject to one or more constraints to approximate a three-dimensional beampattern, wherein the approximated three-dimensional beampattern comprises a side lobe that includes a direction for which a waveform detected by the sensor array is suppressed, and wherein the one or more constraints of the convex optimization includes a first constraint that suppression of the waveform detected by the sensor array from the side lobe, is greater than a predetermined threshold, the predetermined threshold being dependent on at least a frequency of the waveform.

8. The method of claim 7, wherein the one or more constraints further include a second constraint that a white noise gain of the approximated three-dimensional beampattern is greater than a second threshold.

9. The method of claim 8, wherein the second threshold is dependent on the frequency of the waveform, the second threshold comprising a first value at a first frequency and a second value at a second frequency higher than the first frequency, wherein the second value is lower than the first value.

10. The method of claim 7, wherein the approximated three-dimensional beampattern further comprises a main lobe that includes a look direction for which a waveform detected by the sensor array is not suppressed, and wherein the one or more constraints further include a second constraint that the waveform detected by the sensor array from the look direction receives a gain of unity.

11. The method of claim 10, wherein the approximated three-dimensional beampattern further comprises a back lobe extending from the sensor array towards a wall, and the back lobe is smaller than the main lobe.

12. The method of claim 7, wherein each of the at least three sensors comprises a microphone.

13. The method of claim 7, wherein the approximated three-dimensional beampattern comprises a horizontal beam width and a vertical beam width, and wherein the vertical beam width is greater than the horizontal beam width.

14. The method of claim 7, further comprising:

receiving input from a user selecting a location of the sensor array; and determining the weighting coefficients based on the selected location from a memory.

15. One or more non-transitory computer-readable storage media comprising computer-executable instructions to:

receive at least three input signals from a sensor array comprising at least three sensors arranged in a planar array, each of the at least three input signals detected by one of the at least three sensors;

apply weighting coefficients to each input signal to generate at least three weighted input signals; and determine an output signal based at least in part on the weighted input signals;

wherein the weighting coefficients are determined based at least in part on using convex optimization subject to one or more constraints to approximate a three-dimensional beampattern, wherein the approximated three-dimensional beampattern comprises a side lobe that includes a direction for which a waveform detected by the sensor array is suppressed, and wherein the one or more constraints of the convex optimization includes a first constraint that suppression, of the waveform detected by the sensor array from the side lobe, is greater than a predetermined threshold, the predetermined threshold being dependent on at least a frequency of the waveform.

16. The one or more non-transitory computer-readable storage media of claim 15, wherein the one or more constraints further include a second constraint that a white noise gain of the approximated three-dimensional beampattern is greater than a second threshold.

17. The one or more non-transitory computer-readable storage media of claim 16, wherein the second threshold is dependent on the frequency of the waveform, the second threshold comprising a first value at a first frequency and a second value at a second frequency higher than the first frequency, wherein the second value is lower than the first value.

18. The one or more non-transitory computer-readable storage media of claim 15, wherein the approximated three-dimensional beampattern further comprises a main lobe that includes a look direction for which a waveform detected by the sensor array is not suppressed, and wherein the one or more constraints further include a second constraint that the waveform detected by the sensor array from the look direction receives a gain of unity.

19. The one or more non-transitory computer-readable storage media of claim 18, wherein the approximated three-dimensional beampattern further comprises a back lobe extending from the sensor array towards a wall, and the back lobe is smaller than the main lobe.

20. The one or more non-transitory computer-readable storage media of claim 15, wherein each of the at least three sensors comprises a microphone.

21. The one or more non-transitory computer-readable storage media of claim 15, wherein the approximated three-dimensional beampattern comprises a horizontal beam width and a vertical beam width, and wherein the vertical beam width is greater than the horizontal beam width.

22. The one or more non-transitory computer-readable storage media of claim 15, further comprising computer-executable instructions to:

receive input from a user selecting a location of the sensor array; and determine the weighting coefficients based on the selected location from a memory.

* * * * *